United States Patent [19]

Smirmaul

[11] Patent Number: 4,744,557

[45] Date of Patent: May 17, 1988

[54] DOWNHILL SKI EXERCISE DEVICE

[76] Inventor: Heinz J. Smirmaul, 1307 Brookstone La., Duncanville, Tex. 75137

[21] Appl. No.: 62,869

[22] Filed: Jun. 16, 1987

[51] Int. Cl.[4] ..... A63B 69/18

[52] U.S. Cl. ..... 272/97; 434/253

[58] Field of Search ..... 272/69, 70, 97, 132, 272/146; 434/253

[56] References Cited

U.S. PATENT DOCUMENTS

| | | | |
|---|---|---|---|
| 2,274,081 | 2/1942 | Mautin | 272/97 |
| 2,906,532 | 9/1959 | Echols | 272/57 |
| 3,461,857 | 8/1969 | Poulin | 128/25 |
| 3,565,424 | 2/1971 | Macabet et al. | 272/80 |
| 3,582,066 | 6/1971 | Keryluk | 272/97 |
| 3,591,172 | 7/1971 | Hude | 272/97 |
| 3,707,283 | 12/1972 | Cormier | 272/57 B |
| 3,708,163 | 1/1973 | Hynes | 272/57 B |
| 3,729,207 | 4/1973 | Reynolds | 280/11.2 |
| 3,807,727 | 4/1974 | Ferguson | 272/57 B |
| 3,912,260 | 10/1975 | Rice | 272/57 B |
| 4,023,795 | 5/1977 | Pauls | 272/97 |
| 4,101,136 | 7/1978 | Corll | 272/97 |
| 4,148,477 | 4/1979 | Larson | 272/56.5 SS |
| 4,396,189 | 8/1983 | Jenkins | 272/97 |
| 4,423,864 | 1/1984 | Wiik | 272/97 |
| 4,429,869 | 2/1984 | Eckstein | 272/97 |
| 4,595,195 | 6/1986 | Miehlich | 272/97 |
| 4,607,839 | 8/1986 | Knudson | 272/97 |
| 4,645,202 | 2/1987 | Tomba et al. | 272/97 |

FOREIGN PATENT DOCUMENTS

| | | | |
|---|---|---|---|
| 2443695 | 3/1976 | Fed. Rep. of Germany | 272/97 |

*Primary Examiner*—Richard J. Apley
*Assistant Examiner*—S. R. Crow
*Attorney, Agent, or Firm*—Richards, Harris, Medlock & Andrews

[57] ABSTRACT

A ski exercise device (20) includes a stationary mainframe (22) and an arcuate track (50) having first (50*a*) and second (50*b*) ends. The ends (50*a*, 50*b*) of the arcuate track (50) are connected to the stationary mainframe (22). A rail (70) having ends (70*a*, 70*b*) is provided. The rail (70) is pivotally mounted to the stationary mainframe (22) and includes a wheel (78) for engaging the arcuate track (50). The rail (70) moves along the arcuate track (50) between the ends (50*a*, 50*b*). Biasing structure (200) biases the rail (70) to the stationary mainframe (22) such that the rail (70) acts against the force created by the biasing structure (200) as the rail (70) moves along the arcuate track (50). Structure (90, 92) is provided which is mounted to the rail (70) for supporting the user of the ski exercise device (20) and which allows for longitudinal and rotational motion of the user's feet.

12 Claims, 6 Drawing Sheets

DOWNHILL SKI EXERCISE DEVICE

TECHNICAL FIELD

This invention relates to exercising devices, and more particularly to an exercise device for simulating skiing, especially downhill.

BACKGROUND ART

In recent years, the popularity of snow skiing has greatly increased. Although many individuals have participated in this sport, most people are only occasional skiers and do not take the proper steps necessary before skiing to train themselves and to assure that they are in proper physical condition before taking to the slopes. While ski training and exercising equipment has been provided in the past, such devices have not adequately simulated sufficiently either the actual skiing movements or the forces to be expected during skiing maneuvers.

Downhill, slalom or Alpine skiing as opposed to Nordic or cross country skiing requires the user to carry out unique and strenuous movements while skiing. Generally, these movements include the following: a more or less up-and-down movement; stressing of the outer ski in a curve with a simultaneous lowering of the outer ski; inclination of the skis (edge setting) so that the inner edges of the ski are in contact with the snow in a turn; turning of the feet with the toes facing inwardly in the turn; and the longitudinal shifting of the feet with the inner ski located ahead of the outer ski in a turn. Several motions involve an up-and-down movement with a lowermost position during the making of a turn with the smallest radius. Alternatively, the skier can also lower his body while running straight downhill which involves running with the upper part of the body relatively motionless but with pronounced leg action, particularly involving the muscles of the thighs. Turns are made with pronounced straightening of the knee joints.

In parallel skiing, the skier pumps his legs so as to lower his body, raise his body, and then lower his body again. It is this body movement which unweights the skis, particularly at the rear ends thereof so that the major contact of the skis with the snow surface is at the forward or tip end of the skis. This configuration permits the rear ends of the skis to be moved laterally to the left if the skier is executing a right turn. As the rear ends of the skis are shifted laterally to the left, the skis are rotated slightly about their longitudinal axes so as to raise the left edge portions thereof and the right hand ski is shifted slightly forward of the left ski.

A ski exercising apparatus which is used by downhill skiers must be capable of enabling the user to perform the above-enumerated movements as well as allowing the user to develop coordination and muscle strength. Such an exercising device should present a force which must be overcome by the user who thereby builds his muscles and becomes aware of the conditions under which stressing of certain muscles or groups of muscles takes place during downhill skiing. As with any other type of exercising device, the exercising device must be easy to use to encourage the exerciser to routinely use the device without becoming bored. The more accurately the simulated movements can be reproduced through an exercising device, the greater use of the device will be made with the accompanying benefits to the user.

A need has thus arisen for a downhill ski exercising device which enables the user to perform the various movements actually required in downhill skiing, to thereby strengthen muscles and allow the user to become aware of the conditions under which stressing of certain muscles takes place during actual skiing. Such an exercising device must be simple in construction to allow easy use, minimal maintenance and durable for extended exercising periods.

DISCLOSURE OF THE INVENTION

In accordance with one aspect of the present invention, a ski exercise device includes a frame and a track having first and second ends. The ends of the track are connected to the frame. A rail having first and second ends is provided. The first end of the rail is pivotally mounted to the frame and the second end includes a roller for engaging the track. The rail moves along the track between the first and second ends of the track. Structure is provided for biasing the rail to the frame, such that the rail acts against the force created by the biasing structure as the rail moves along the track between the first and second ends of the track. Structure is mounted to the rail between the first and second ends for supporting the user of the device.

In accordance with another aspect of the present invention, a frame having first and second ends and lying in a first plane is provided. An arcuate track having first and second ends and a central portion disposed between the first and second ends is connected to the frame. The arcuate track is disposed in a second plane generally perpendicular to the first plane with the central portion of the track disposed above the first plane. A rail having first and second ends is provided with the first end being pivotally mounted to the second end of the frame. The rail second end includes a roller for engaging the arcuate track. A flywheel is rotatably mounted to the frame. A cable interconnects the flywheel and the rail. Structure is provided for biasing the rail to the frame such that the rail has a neutral position when located adjacent to the central portion of the arcuate track and is movable along the arcuate track between the first and second ends by the user of the exercising device by overcoming the force exerted by the biasing structure and the flywheel to thereby impart rotational motion to the flywheel. A support platform for receiving the boots of the user of the device is mounted to the rail between the first and second ends for slidable longitudinal motion along the rail and rotational motion about the longitudinal axis of the rail to allow the feet of the user of the device to move back and forth between the rail first and second ends as well as to rotate in the direction of movement of the rail along the arcuate track to thereby simulate up-and-down movements, edge setting and longitudinal shifting of the feet by the user of the device.

BRIEF DESCRIPTION OF THE DRAWINGS

For a more complete understanding of the present invention and for further advantages thereof, reference is now made to the following Detailed Description taken in conjunction with the accompanying Drawings, in which.

DETAILED DESCRIPTION

Figure 1:
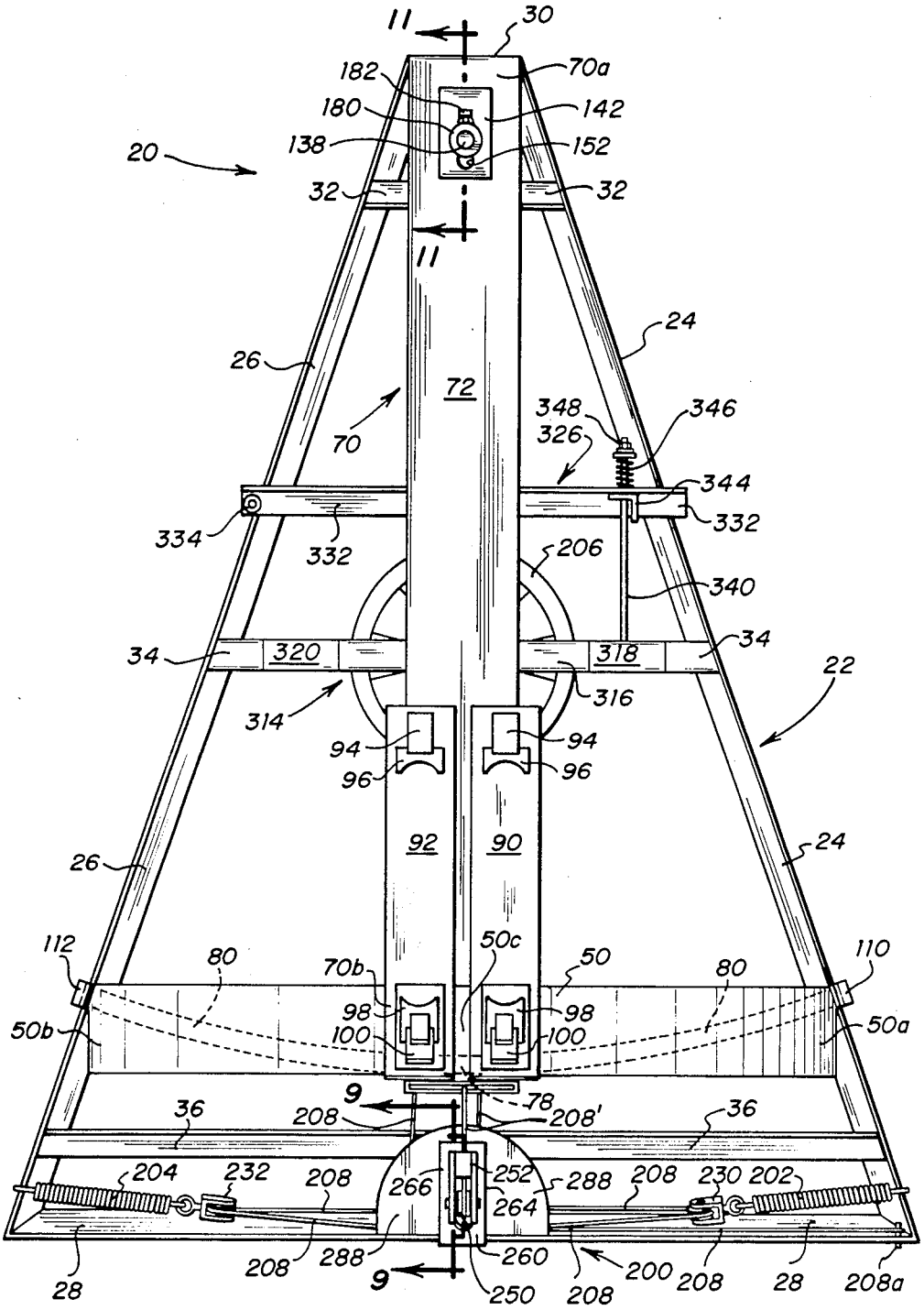
FIG. 1 is a top plan view of the ski exercising device of the present invention.
Figure 3:
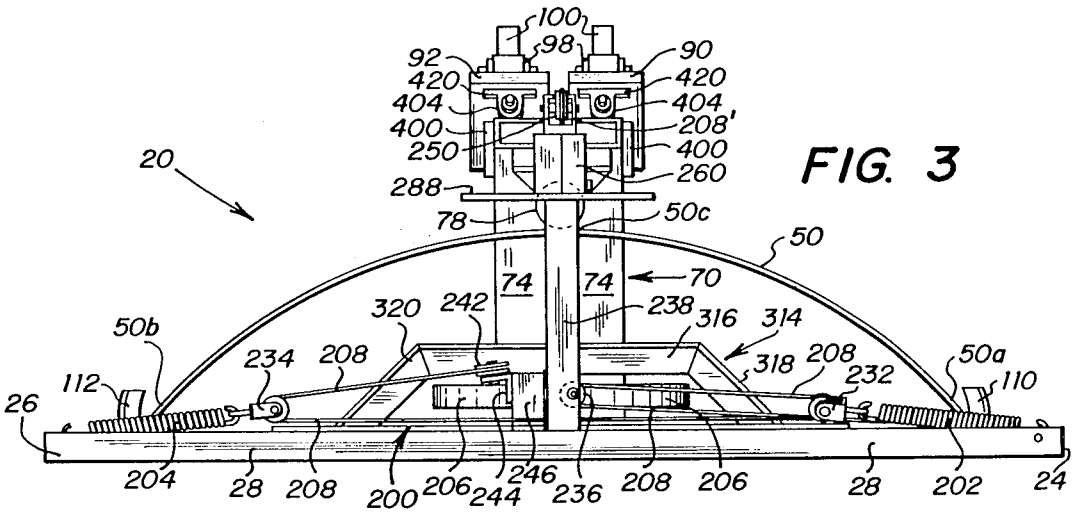
FIG. 3 is a rear elevational view of the ski exercising device illustrated in FIG. 1.
Figure 2:
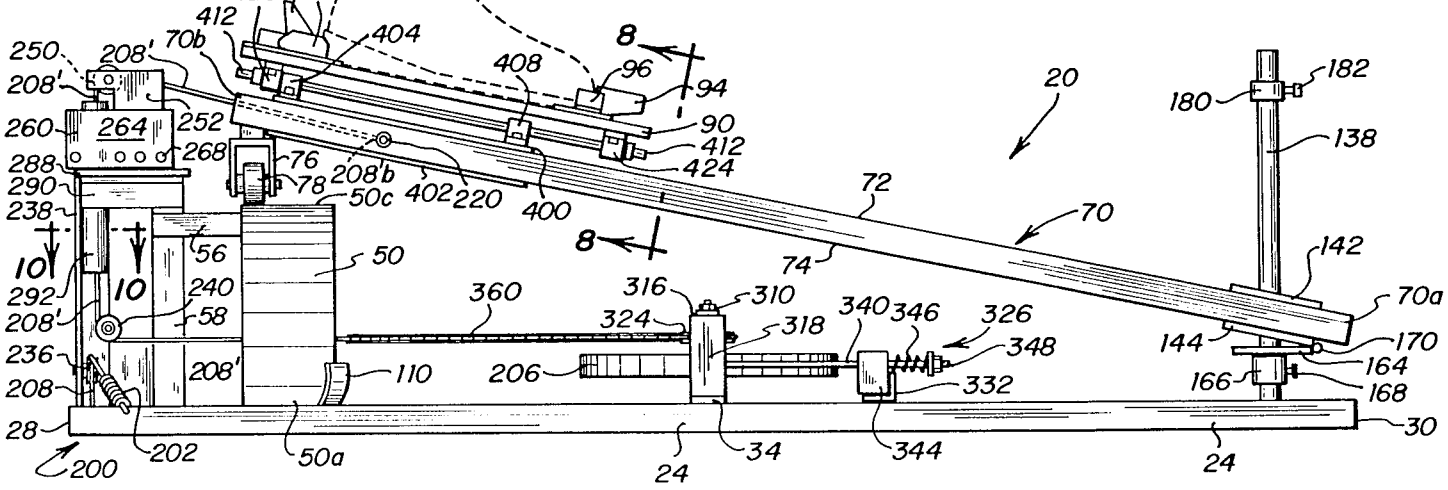
FIG. 2 is a side elevational view of the ski exercising device illustrated in FIG. 1.

Referring simultaneously to FIGS. 1, 2 and 3, the present ski exercise device is illustrated and is generally identified by the numeral 20. Ski exercise device 20 can be used for the practice and simulation of skiing, especially for the practice of downhill or slalom runs and for exercising those parts of the body whose conditioning is especially important for a safe and satisfactory downhill ski run. The ski exercise device 20 includes a stationary mainframe, generally identified by the numeral 22 which is disposed in a first plane and which is positioned on the floor for use. Stationary mainframe 22 is generally triangular in configuration and includes side members 24 and 26 and a base member 28. Side members 24 and 26 are interconnected via a top frame member 30, a front transverse member 32, a central transverse member 34 and a rear transverse member 36. The members 24–36 of stationary mainframe 22 may be interconnected by welding, nuts and bolts, or the like.

Ski exercising device 20 includes an arcuately shaped track 50 having ends 50*a* and 50*b* and a central portion 50*c*. As more clearly shown in FIG. 3, arcuate track 50 is disposed in a second plane perpendicular to the plane of stationary mainframe 22. The highest point on arcuate track 50 is central portion 50*c*. Arcuate track 50 is attached to side members 24 and 26 at ends 50*a* and 50*b*, respectively, by welding or the like. The central portion 50*c* of arcuate track 50 is supported by a brace 56 (FIG. 3) extending below arcuate track 50 which is interconnected to a leg 58. Leg 58 is perpendicularly disposed to and interconnected to rear transverse member 36 of stationary mainframe 22 by welding or the like.

Figure 4:
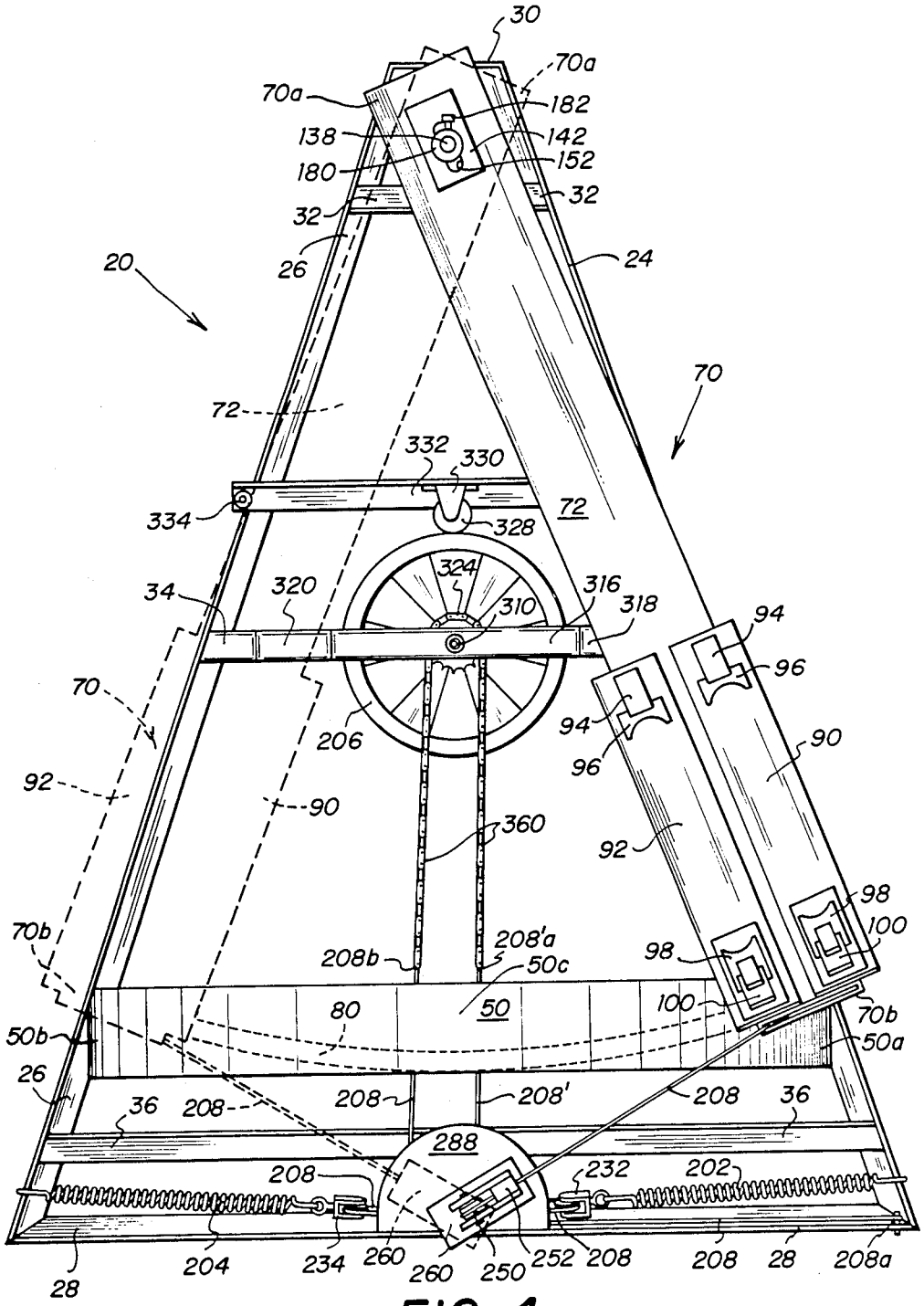
FIG. 4 is a top plan view of the ski exercising device illustrated in FIG. 1 showing the two outermost positions of the rail of the present invention.

Pivotally interconnected adjacent to top frame member 30 of stationary mainframe 22 is a rail generally identified by the numeral 70. Rail 70 includes ends 70*a* and 70*b* and may be fabricated, for example, from an aluminum extrusion having a generally rectangular configuration in cross-section. Rail 70 has a top surface 72 and a bottom surface 74. Mounted adjacent to end 70*b* of rail 70 on bottom 74 is a bracket 76 (FIG. 2) for rotatably mounting a wheel 78. Bracket 76 supports wheel 78 along arcuate track 50 such that wheel 78 allows rail 70 to rotate along arcuate track 50 between ends 50*a* and 50*b* to the outermost positions of stationary mainframe 22 as illustrated in FIG. 4. Wheel 78 travels along arcuate track 50 along a path illustrated by dotted line 80 (FIGS. 1 and 4) between ends 50*a* and 50*b* of arcuate track 50.

Still referring simultaneously to FIGS. 1, 2 and 3, the user of the present ski exercise device 20 places his boots 88 (FIG. 2) onto ski boot supports 90 and 92 which are mounted to top surface 72 of rail 70. The boots 88, illustrated in dotted lines of FIG. 2 are positioned on ski boot supports 90 and 92 where the user stands during use of the present ski exercise device 20. Ski boot supports 90 and 92 are positionable along rail 70 between ends 70*a* and 70*b* to accommodate skiers of various heights. For example, for shorter skiers having shorter skis, ski boot supports 90 and 92 would be located closer to end 70*a* of rail 70. As will subsequently be described, the user of the present ski exercise device 20 stands on ski boot supports 90 and 92 and causes rail 70 to rotate along arcuate track 50 between arcuate track 50 ends 50*a* and 50*b* during use of the present ski exercise device 20. Boot 88 is positioned on ski boot supports 90 and 92 between a bearing block 94 having a toe receiving portion 96 and a bearing block which is slidably adjustable to accommodate various sizes of ski boots in much the same way a ski boot is attached to a ski. Bearing block 98 includes a release lever 100 for slidably moving and locking bearing block 98 in place once boot 88 is positioned on ski boot supports 90 and 92. The operation of ski boot supports 90 and 92 will subsequently be described in connection with FIGS. 5–8.

Mounted adjacent to arcuate track 50 ends 50*a* and 50*b* along side members 24 and 26 of stationary mainframe 22 are stop members 110 and 112, respectively. Stop members 110 and 112, receive wheel 78 at the ends of the path of motion of wheel 78 and also cushion the impact of rail 70 at the outer boundaries of its motion.

Figure 11:
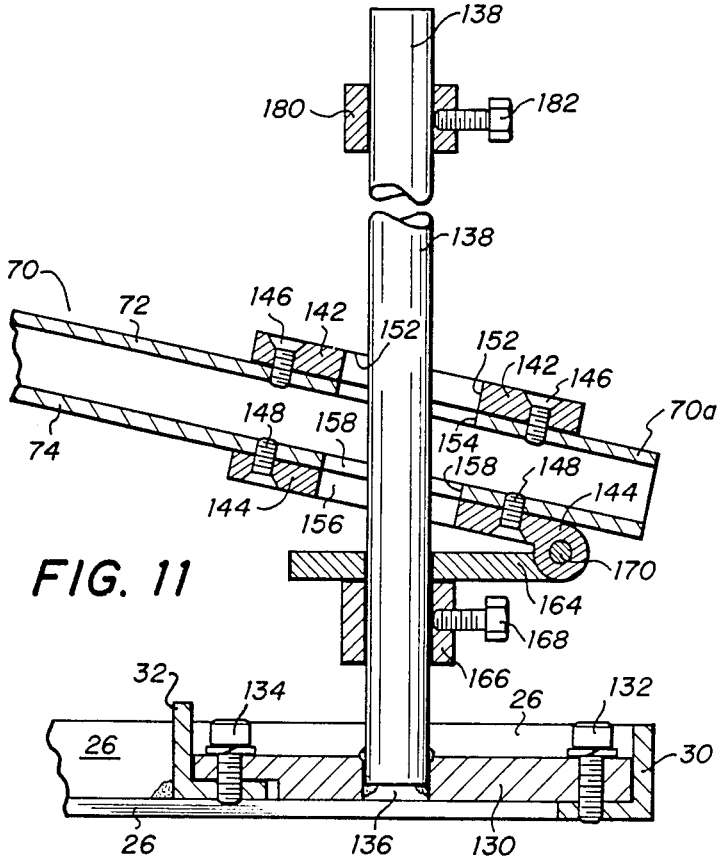
FIG. 11 is a cross-sectional view taken generally along sectional lines 11—11 of FIG. 1 illustrating the rail-frame pivotal mounting structure.

As previously stated, end 70*a* of rail 70 is pivotally mounted to stationary mainframe 22 which allows rail 70 to move along arcuate track 50. Referring simultaneously to FIGS. 1, 2 and 11, the pivotal interconnection of rail 70 to stationary mainframe 22 will now be discussed. Referring initially to FIG. 11, mounted between top frame member 30 and front transverse member 32 is a plate 130. Plate 130 is mounted to top frame member 30 and front transverse member 32 utilizing bolts 132 and 134 respectively. Plate 130 includes an aperture 136 through which a centrally disposed shaft 138 is mounted. Shaft 138 is welded to plate 130. Rail 70 is pivotally mounted to shaft 138 through the use of an upper mounting plate 142 and a lower mounting plate 144. Upper mounting plate 142 is mounted to the top surface 72 of rail 70 utilizing screws 146. Lower mounting plate 144 is mounted to bottom surface 74 of rail 70 utilizing screws 148. Upper mounting plate 142 includes a slotted aperture 152 which aligns with a slotted aperture 154 contained within top surface 72 of rail 70. Lower mounting plate 144 includes a slotted aperture 156 which aligns with a slotted aperture 158 in bottom surface 74 of rail 70. Apertures 152, 154, 156 and 158 allow rail 70 to move in a longitudinal direction with respect to shaft 138, that is in the direction of the longitudinal axis of rail 70 and not transverse to the longitudinal axis of rail 70 since these apertures are elongated slots as shown in FIGS. 1 and 4.

Lower mounting plate 144 is hingably attached to a shaft mounting plate 164 through a pin 170. Shaft mounting plate 164 and end 70*a* of rail 70 is mounted to shaft 138 through a collar 166 which allows for the positioning of end 70*a* of rail 70 in the vertical position along shaft 138 which changes the angle of inclination of rail 70. The steeper the angle, the more strenuous a workout the user will achieve using exercise device 20. Collar 166 is locked to shaft 138 using a bolt 168. Lower mounting plate 144 and shaft mounting plate 164 operate as a hinge to allow rail 70 to move in a vertical and horizontal direction as rail 70 moves between ends 50*a* and 50*b* of arcuate track 50. At the position of rail 70 at the ends of arcuate track 50, lower mounting plate 144 would be parallel to shaft mounting plate 164. Slotted apertures 152, 154, 156 and 158 in upper mounting plate 142, lower mounting plate 144 and rail 70 allow rail 70 to pivot around shaft 138 as rail 70 moves along arcuate track 50. Rail 70 during the course of this movement does not twist and top surface 72 moves through parallel planes which are generally parallel to the plane containing stationary mainframe 22. End 70*a* of rail 70 is locked to shaft 138 using a collar 180 and a locking bolt 182. Collar 180 is positioned on shaft 138 after rail 70 is assembled to shaft 138.

Referring again simultaneously to FIGS. 1 through 3 and now 4, the present ski exercise device 20 includes biasing structure generally identified by the numeral 200 for interconnecting end 70*b* of rail 70 to stationary mainframe 22. Biasing structure 200 provides a counterforce which must be overcome by the user of the present ski exercise device 20 as the user supported on ski boot supports 90 and 92 causes rail 70 to move along arcuate track 50. Biasing structure 200 biases rail 70 to a neutral position as illustrated in FIG. 1 in which wheel 78 is located at central portion 50*c* at the top of arcuate track 50. The user must overcome the force provided by biasing structure 200 in order to move rail 70 to the position adjacent side member 24 of stationary mainframe 22 shown in FIG. 4 in solid lines and to the position shown in dotted lines of rail 70 located adjacent side member 26 of stationary mainframe 22.

Biasing structure 200 includes springs 202, 204 and a flywheel 206 interconnected by a cable 208 and 208'. Cable 208 includes end 208*a* which is attached to base member 28 of stationary mainframe 22. Cable 208' includes end 208'*b* (FIG. 2) which passes through end 70*b* of rail 70 and is attached to rail 70 at a position below ski boot supports 90 and 92 using a bolt 220 (FIG. 2). Spring 202 has one end attached to side member 24 and is interconnected at its other end to a pulley 230. Spring 204 has one end connected to side member 26 in its other end interconnected to a pulley 232.

Biasing structure 200 further includes a wheel 236 mounted to a leg 238 (FIGS. 2 and 3) which is interconnected to base member 28. Also attached to leg 238 is a wheel 240 (FIG. 3). Biasing structure 200 further includes a wheel 242 (FIG. 3) interconnected to a bracket 244 which is interconnected to a leg 246. Leg 246 is interconnected to base member 28.

Figure 9:
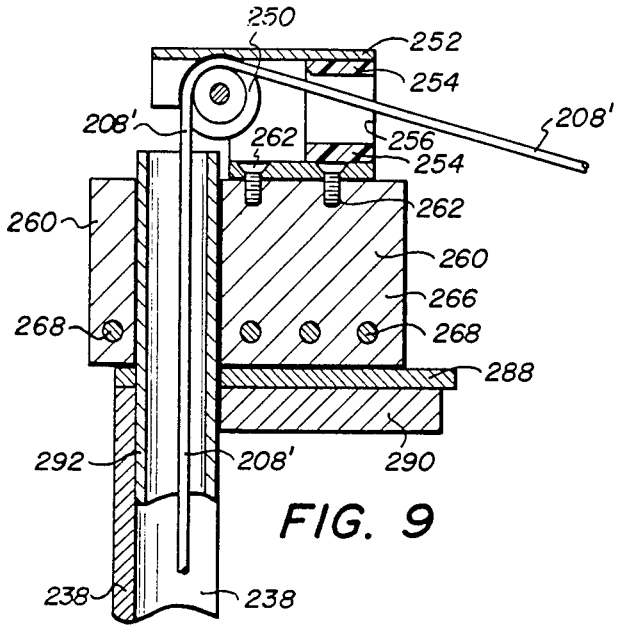
FIG. 9 is a cross-sectional view taken generally along sectional lines 9—9 of FIG. 1 illustrating a cable housing of the present invention.
Figure 10:
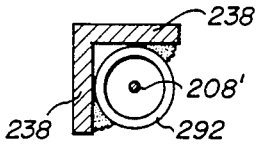
FIG. 10 is a cross-sectional view taken generally along sectional lines 10—10 of FIG. 2 illustrating the cable housing of the present invention.

Referring simultaneously to FIGS. 1, 9 and 10, biasing structure 200 further includes a wheel 250 which is mounted to a bracket 252. Bracket 252 includes a bushing 254 positioned in an aperture 256 through which cable 208 passes. Bracket 252 is mounted to a block 260 using screws 262. Block 260 includes sidewalls 264 and 266 (FIG. 1) interconnected by fasteners 268. Sidewalls 264 and 266 of block 260 are supported on a support plate 288. Support plate 288 is attached to a brace 290 which is interconnected to legs 238 and 58. Cable 208' extends through support plate 288 to engage wheel 250. Positioned through support plate 288 and attached to leg 238 is a bushing 292 through which cable 208' passes.

Biasing structure 200 further includes flywheel 206 which is rotatably mounted to central transverse member 34 of stationary mainframe 22 on a shaft 310. Flywheel 206 rotates in a plane parallel to stationary mainframe 22. Shaft 310 (FIGS. 2 and 4) mounts flywheel 206 to central transverse member 34 and a mounting bracket 314 having a top member 316 and side members 318 and 320. Mounted to shaft 310 is a ratchet wheel 324 (FIG. 4) through which motion is imparted to flywheel 206. Flywheel 206 also includes a tensioning device generally identified by numeral 326. Tensioning device 326 includes a wheel 328 (FIG. 4) which bears against the surface of flywheel 206 to increase or decrease the amount of effort required to turn flywheel 206. Wheel 328 is mounted to a bracket 330 which in turn is mounted to a transverse member 332 extending between side members 24 and 26 of stationary mainframe 22. Transverse member 332 is pivotally mounted to side member 26 using a bolt 334. Positioning of transverse member 332 with respect to central transverse member 34 is controlled by a tension adjustment rod 340 which extends between transverse member 332 and central transverse member 34. Rod 340 is interconnected to mounting bracket portion 318 at one end and at its other end passes through a bracket 344 which is attached to transverse member 332. The end of rod 340 passing through bracket 344 includes a spring 346 whose position is controlled by an adjustment knob 348. The tensioning of spring 346 against bracket 344 causes pivotal movement of transverse member 332 about bolt 332 towards and away from central transverse member 34 to cause wheel 328 to engage flywheel 206.

The operation of biasing structure 200 will now be described. Referring again to FIGS. 1 through 4, cable 208 extends from its point of attachment, 208*a* to base member 28 to wheel 236 attached to leg 238 (FIG. 3). Cable 208 then passes around wheel 238 to pulley 230 which is attached to spring 202 (FIGS. 1 and 3). After passing around pulley 230, cable 208 passes between leg 238 and leg 58 to pulley 232 attached to spring 204. Cable 208 after passing around pulley 232 passes around wheel 242 attached to leg 246. Cable 208 passes around wheel 242 in the direction of flywheel 206. Cable 208 is then interconnected at end 208*b* to a chain 360 (FIGS. 2 and 4) which extends around ratchet 324. The other end of chain 360 is attached to end 208'*a* of second cable 208' which extends to wheel 240 (FIG. 2). Cable 208' then extends upwardly through bushing 292 (FIGS. 2 and 9) to engage wheel 250. Cable 208' after engaging wheel 250 passes through bushing 254 to connect to rail 70 at bolt 220 (FIG. 2).

It therefore can be seen that as rail 70 moves between its two extreme positions adjacent side members 24 and 26, cable 208 is displaced as springs 202 and 204 expand which in turn causes chain 360 to move and rotate flywheel 206 through ratchet 324. As rail 70 is moved by the user of ski exercise device 20 to the positions shown in FIG. 4, springs 202 and 204 will expand to their full extent such that pulley 232 lies adjacent to wheel 242 (FIG. 3) and pulley 234 lies adjacent to wheel 242 (FIG. 3). The energy stored in springs 202 and 204 in their expanded position will then cause rail 70 to move to the neutral position of rail 70 at central portion 50*c*. The repeated expansion and contraction of springs 202 and 204 occurs as rail 70 moves between positions shown in FIG. 4 as rail 70 moves along arcuate track 50. The user of ski exercise device 20 must overcome the forces of springs 202 and 204 in order to move rail 70 between the two positions shown in FIG. 4 since springs 202 and 204 and cables 208 and 208' tend to move rail 70 to the neutral position shown in FIG. 1. Additional force required to move rail 70 which must be overcome by the user of ski exercise device 20 is created by flywheel 206. The amount of force exerted by flywheel 206 is controlled by the positioning of wheel 328 which provides friction which must be overcome in order to turn flywheel 206 as rail 70 moves along arcuate track 50. The forces established by biasing structure 200 which must be overcome by the user of ski exercise device 20 provide a conditioning and muscular activity of the user for ski exercise device 20. As the user moves along arcuate track 50, biasing structure 200 simulates the up-and-down movement associated with downhill skiing as the skier unweights the skis as he moves up and down. The up movement or unweighting occurs as biasing structure 200 returns rail 70 to the neutral position, and the weighting or down motion occurs as rail 70 is moved along arcuate track 50 to the end positions 50*a* and 50*b* as shown in FIG. 4.

The simulation of stressing the outer ski in a curve with the simultaneous lowering of the outer ski, inclination of the skis or edge setting and the longitudinal shifting of the feet of the skier with the inner ski located ahead of the outer ski in a turn that can be simulated utilizing the present ski exercise device 20 will now be discussed. Referring simultaneously to FIGS. 2–8, ski boot supports 90 and 92 are slidably mounted for simultaneous movement in a longitudinal direction along rail 70 as well as rotationally mounted for rotation about the axis of rail 70. Each ski boot support 90 and 92 is identically mounted to rail 70 and therefore, a single reference numeral will be utilized for common components in the mounting structures. Each ski boot support 90 and 92 is independently mounted for movement along and about rail 70. Interconnected to rail 70 through the top surface 72 and extending through rail 70 is a T-member 398. T-member 398 includes a plate 400 disposed adjacent to top surface 72 of rail 70 and a vertical portion 402 which extends through rail 70 and which is affixed to rail 70 by bolt 220. A bracket 404 is mounted to plate 400 using bolts 406. A bracket 408 is mounted to plate 400 using bolts 410. Brackets 404 and 408 include an aperture through which a shaft 412 is received. Shaft 412 is slidable within brackets 404 and 408.

Mounted to ski boot supports 90 and 92 are brackets 420 and 424 utilizing bolts 422 and 426, respectively. An aperture within brackets 420 and 424 allows shaft 412 to be received by brackets 420 and 424 such that ski boot supports 90 and 92 longitudinally move with respect to the ends of rail 70 as well as allows ski boot supports 90 and 92 to simultaneously rotate about the longitudinal axis of rail 70.

Figure 5:
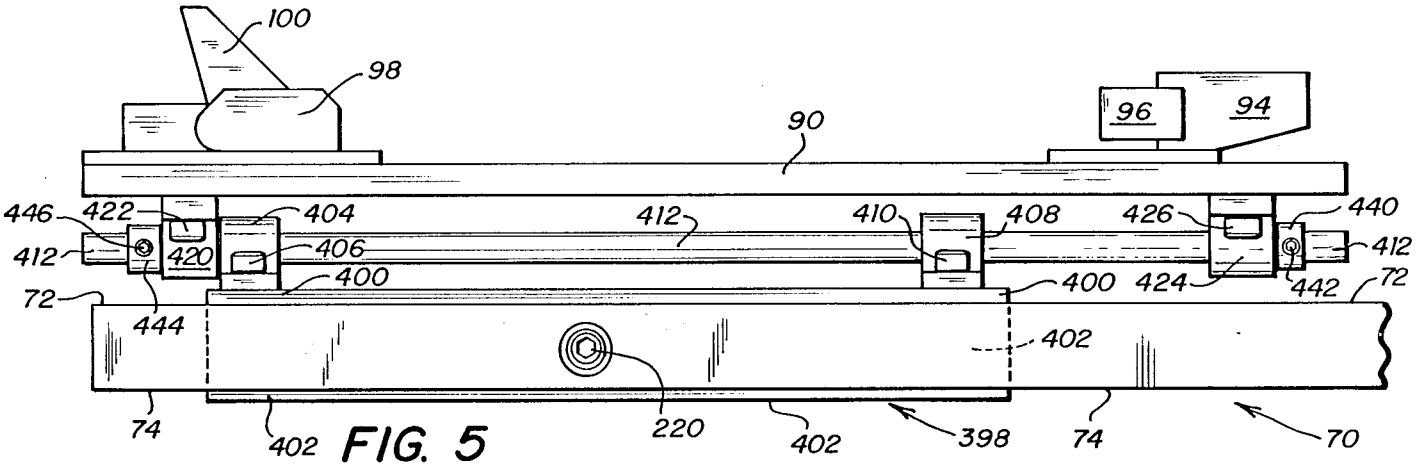
FIG. 5 is an enlarged side elevational view of the boot platform of the present invention in the forward position.
Figure 6:
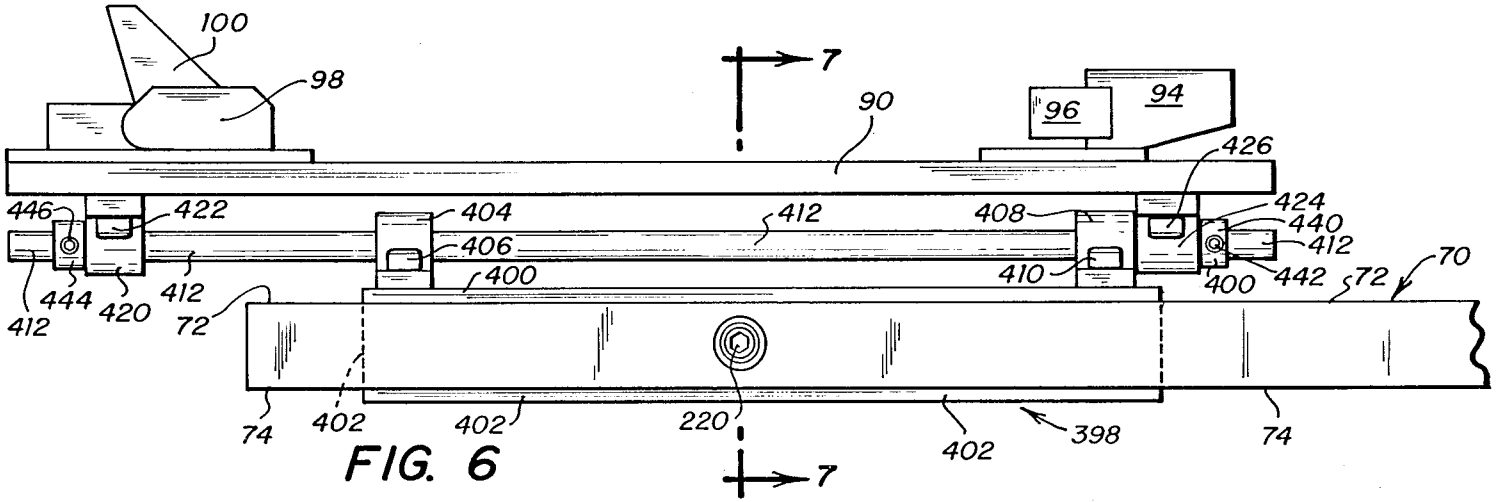
FIG. 6 is an enlarged side elevational view of the boot platform of the present invention in the rearmost position.
Figure 7:
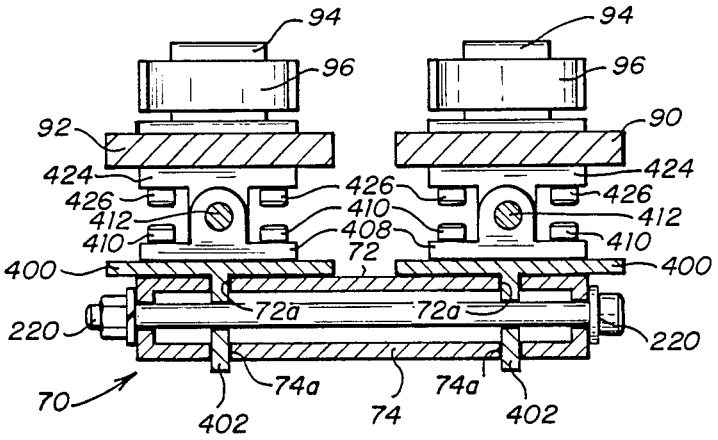
FIG. 7 is a cross-sectional view of the boot platform of the present invention taken generally along sectional lines 7—7 of FIG. 6.

As shown in FIGS. 5 and 6, shaft 412 longitudinally moves between a forwardmost position as shown in FIG. 5 and a rearwardmost position as shown in FIG. 6 to allow the user of ski exercise device 20 to shift his feet forward and back simulating foot movement in a turn. Since ski boot supports 90 and 92 operate independently of each other, the feet of the user can be moved relative to each other such that one foot can either be parallel to, behind or forward of the other along rail 70 as rail 70 moves along track 50.

Ski boot supports 90 and 92 are retained on shaft 412 using a forward collar 440 and locking bolt 442 and a rearward collar 444 and locking bolt 446.

Figure 8:
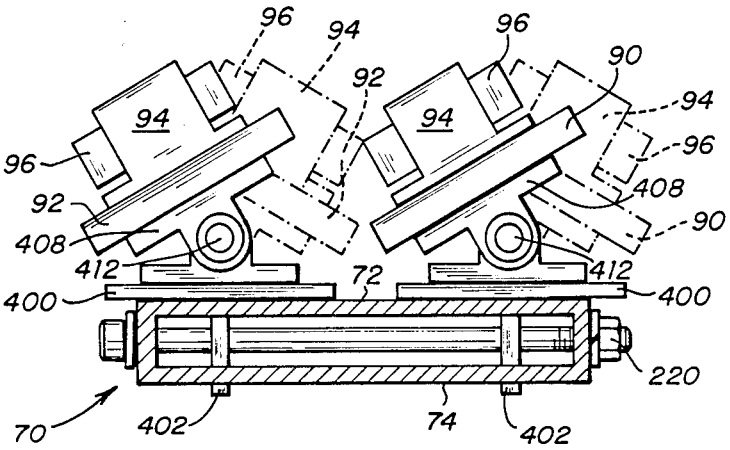
FIG. 8 is a sectional view taken generally along sectional lines 8—8 of FIG. 2 illustrating the rotational positions of the boot platforms of the present invention.

FIG. 8 illustrates the rotational motion of ski boot supports 90 and 92 which allows the user of the present ski exercise device 20 to simulate stressing of the outer ski in a curve with the lowering of the outer ski, and inclination of the skis so that their edges are in contact with the snow in a turn. Ski boot supports 90 and 92 rotate about shaft 412 such that ski boot support 90 rotates between the solid line position shown in FIG. 8 and the dashed line shown in FIG. 8. Ski boot support 92 rotates about shaft 412 from the solid line position shown in FIG. 8 to the dotted-dashed line shown in FIG. 8. The rotational movement of ski boot supports 90 and 92 simulates the skier skiing on the edges of his skis in a turn while skiing downhill and occurs simultaneously with the longitudinal movement of ski boot supports 90 and 92 shown in FIGS. 5 and 6.

It therefore can be seen that the present invention provides for an exercise device simulating downhill skiing. The present exercise device allows the user to simulate many of the movements required in downhill skiing including the up-and-down movement, stressing of the outer ski in a curve with the lowering of the outer ski, edge setting as well as the longitudinal shifting of feet with the inner ski located ahead of the outer ski in a turn. The present invention provides various levels of muscular activity due to the adjustable feature of the biasing structure which generates forces that the user must overcome while using the exercise device.

Whereas the present invention has been described with respect to specific embodiments thereof, it will be understood that various changes and modifications will be suggested to one skilled in the art and it is intended to encompass such changes and modifications as fall within the scope of the appended claims.

I claim:

1. A ski exercise device comprising:

a frame;

a track having first and second ends, said ends of said track being connected to said frame;

a rail having first and second ends, said first end being pivotally mounted to said frame and said second end including means for engaging said track, such that said rail moves along said track between said first and second ends of said track;

a flywheel rotatably mounted to said frame;

a cable interconnecting said flywheel and said rail;

means for biasing said rail to said frame, said rail having a neutral position when located centrally between said track first and second ends and being movable along said track between said first and second ends thereof by the user of the device by overcoming the force exerted by said biasing means and said flywheel to thereby impart rotational motion to said flywheel; and means mounted to said rail between said first and second ends for supporting the user of the device.

2. The ski exercise device of claim 1 wherein said frame lies in a first plane and said track lies in a second plane generally perpendicular to said first plane.

3. The ski exercise device of claim 1 wherein said support means includes:

a platform means for receiving the boots of the user of the device, said platform means being mounted to said rail for slidable longitudinal motion along said rail between said first and second ends and for rotational motion with respect to said rail.

4. A ski exercise device comprising:

a frame disposed in a first plane;

an arcuate track having first and second ends and a central portion disposed between said ends, said ends of said arcuate track being connected to said frame and said arcuate track being disposed in a second plane generally perpendicular to said first plane with said central portion being disposed above said first plane;

a rail having first and second ends, said first end being pivotally mounted to said frame and said second end of said rail including means for engaging said arcuate track, such that said rail moves along said arcute track between said first and second ends thereof;

a flywheel rottably mounted to said frame;

a cable interconnecting said flywheel and said rail;

means for biasing said rail to said frame, said rail having a neutral position when located adjacent said central portion of said arcuate track and being movable along said arcuate track between said first and second ends thereof by the user of the device by overcoming the force exerted by said biasing means and said flywheel to thereby impart rotational motion to said flywheel; and means mounted to said rail between said first and second ends thereof for supporting the user of the device.

5. The ski exercise device of claim 4 wherein said means for engaging said arcuate track include roller means.

6. The ski exercise device of claim 4 wherein said support means includes:

platform means for receiving the boots of the user of the device, said platform means being mounted to said rail for slidable longitudinal motion along said rail between said first and second ends and rotational motion with respect to said rail.

7. A ski exercising and simulating device comprising:

a frame having first and second ends and lying in a first plane;

an arcuate track having first and second ends and a central portion disposed between said ends, said ends of said arcuate track being connected to said frame adjacent said first end of said frame, said arcuate track being disposed in a second plane generally perpendicular to said first plane with said central portion thereof being disposed above said first plane;

a rail having first and second ends, said first end being pivotally mounted to said second end of said frame, said rail second end including roller means for engaging said arcuate track;

a flywheel rotatably mounted to said frame;

a cable interconnecting said flywheel and said rail;

means for biasing said rail to said frame, said rail having a neutral position when located adjacent said central portion of said arcuate track and being movable along said arcuate track between said first and second ends thereof by the user of the exercising and simulating device by overcoming the force exerted by said biasing means and said flywheel to thereby impart rotational motion to said flywheel; and platform means for receiving the boots of the user of the device, said platform means being mounted to said rail between said first and second ends for slidable longitudinal motion along said rail and rotational motion about the longitudinal axis of said rail to allow the feet of the user of the device to move back and forth between said rail first and second ends as well as to rotate in the direction of movement of said rail along said arcuate track thereby simulating up and down movements, edge setting and longitudinal shifting of the feet of the user of the device.

8. The ski exercising and simulating device of claim 7 and further including:

means for controlling the amount of resistance offered by said flywheel to the movement of said rail.

9. The ski exercising and simulating device of claim 8 wherein said biasing means includes spring means interconnected to said cable.

10. The ski exercising and simulating device of claim 7 wherein said means for pivotally mounting said rail to said frame includes:

means for mounting said rail such that said rail moves in a plurality of planes parallel to said first plane as said rail moves along said arcuate track between said first and second ends thereof.

11. The ski exercising and simulating device of claim 9 wherein said spring means includes:

first and second springs, such that said springs extend when said rail moves to said first and second ends of said arcuate track.

12. The ski exercising and simulating device of claim 11 and further including:

ratchet means connected to said flywheel and a chain connected to said cable for engaging said ratchet means.

* * * * *